US005915956A

United States Patent [19]

Kwiatek et al.

[11] Patent Number: 5,915,956

[45] Date of Patent: Jun. 29, 1999

[54] GASEOUS FUEL BURNER WITH REDUCED VELOCITY FLAME GENERATING PORTS

[76] Inventors: David J. Kwiatek, 1101 S. Stone Ave., LaGrange, Ill. 60525; Kenneth J. Oda, 623 Ipswich Ct., Elk Grove, Ill. 60007; Donald M. Krueger, 11126 Mandel Ave., Westchester, Ill. 60154

[21] Appl. No.: 08/616,537

[22] Filed: Mar. 18, 1996

[51] Int. Cl.[6] ..... F23Q 3/00; F23D 14/62

[52] U.S. Cl. ..... 431/349; 431/266; 431/354

[58] Field of Search ..... 431/328, 350, 431/354, 326, 7, 349; 239/567, 552, 568, 554, 555

[56] References Cited

U.S. PATENT DOCUMENTS

| | | | |
|---|---|---|---|
| 1,663,339 | 3/1928 | Geurink et al. | 239/552 |
| 2,965,165 | 12/1960 | Arnott et al. | 239/568 |
| 3,315,725 | 4/1967 | Katz et al. | 431/2 |
| 3,874,599 | 4/1975 | Roger | 239/557 |
| 3,992,137 | 11/1976 | Streisel | 239/554 |
| 5,525,056 | 6/1996 | Sutton | 431/328 |

FOREIGN PATENT DOCUMENTS

| | | | |
|---|---|---|---|
| 1134956 | 4/1957 | France | 431/348 |
| 600198 | 6/1934 | Germany | 239/552 |
| 1005912 | 8/1957 | Germany | 239/567 |
| 1429134 | 9/1969 | Germany | 239/567 |
| 0052113 | 3/1984 | Japan | 431/354 |

*Primary Examiner*—Carl D. Price

*Attorney, Agent, or Firm*—Jules Jay Morris; Terrence Martin; Sean Detweiler

[57] ABSTRACT

A cast aluminum burner base has a tubular inlet communicating with a cavity formed in an enlarged diameter flange remote from the inlet. The cavity is closed by a cast aluminum cap registered against the base. The base and cap are each castellated along the parting line such that the castellations are interdigitated. Grooves having semi-circular cross sections and formed radially across the castellations and the spaces between and close on the parting line to form circular cross section primary flame-generating ports. The castellations on the cap are truncated and tapered to provide flame stabilizing passages adjacent alternate flame-generating ports. The grooves forming the primary flame generating ports are configured to preferably form a converging-diverging nozzle; and, the flame stabilizing passages are formed as a diverging nozzle, both for reducing flow velocity to pressurize flame separation.

4 Claims, 3 Drawing Sheets

GASEOUS FUEL BURNER WITH REDUCED VELOCITY FLAME GENERATING PORTS

BACKGROUND OF THE INVENTION

The present invention relates to burners for gaseous fuel and particularly burners of the type employed for cooking appliances such as cooktop arrangements where a plurality of burners are disposed on top of a cabinet for cooking food in receptacles. The invention relates particularly to household cooktop burners where a plurality of burners are supplied from a manifold connected to a source of fuel gas with individual user operated control valves for regulating the flow of gaseous fuel to the individual burners.

Heretofore, it has been commonplace to have a plurality of top burners on a domestic gas range arranged in an array with the individual burners having an annular or generally ring-shaped configuration with the flame generating ports disposed in peripherally spaced relationship to provide a ring of discrete flames emanating from the burner ports. It is known to provide such a burner with a base having a tubular inlet portion and an enlarged diameter end flange for defining a plenum or air/fuel mixing cavity which is closed by a burner cap. The flame-generating ports in such a known burner design are formed in the outer annular rim of the base cavity, such that when the cap is in place gaseous fuel flowing into the tubular inlet is mixed with air typically by an inlet aspirator and is discharged through the burner ports for flame generation. Such known burners employing a base and cap have formed the flame-generating ports extending radially through the outer rim of the base which are closed by the cap to form flame-generating ports.

In such an aforesaid cooktop burner arrangement, when rapid fluctuations in the flow velocity of fuel due, for example, to variations in the fuel supply pressure occur, a condition known as "blowing" occurs where the flame is separated from the flame generating port. Variations in the fuel/air mixture ratio can also produce flame separation; and, such conditions are experienced upon ignition of flame on a cold burner. Flame separation has also been experienced when the burner supply line is preheated from the proximity to a hot oven located below the top burner. In such an arrangement, a condition referred to as a "hot-hot" condition can occur, where the presence of a hot oven superheats the fuel in the top burner supply tube and burner plenum causing increased flow velocity in the flame generating ports, resulting in flame separation. Thus it has been desired to provide a cooktop gaseous fuel burner which has a stable flame at varying fuel flow rates and varying ambient conditions and to provide such a burner at low cost in high volume mass production.

SUMMARY OF THE INVENTION

It is an object of the present invention to provide a gaseous fuel burner for cooktop applications which has improved flame generating properties and is easy to fabricate and low in manufacturing cost and suitable for high-volume production.

It is an object of the present invention to provide a fuel gas burner which provides reduced flow velocity of the fuel/air mixture flowing through the flame generating ports.

The present invention provides flame generating ports formed along the parting line of a burner base and cap with a diverging nozzle formed in each port for reducing flow velocity. In the preferred embodiment a converging-diverging configuration, or venturi is employed in the primary flame generating ports; and, a diverging nozzle is provided in auxiliary flame stabilization ports.

DETAILED DESCRIPTION

Figure 1:
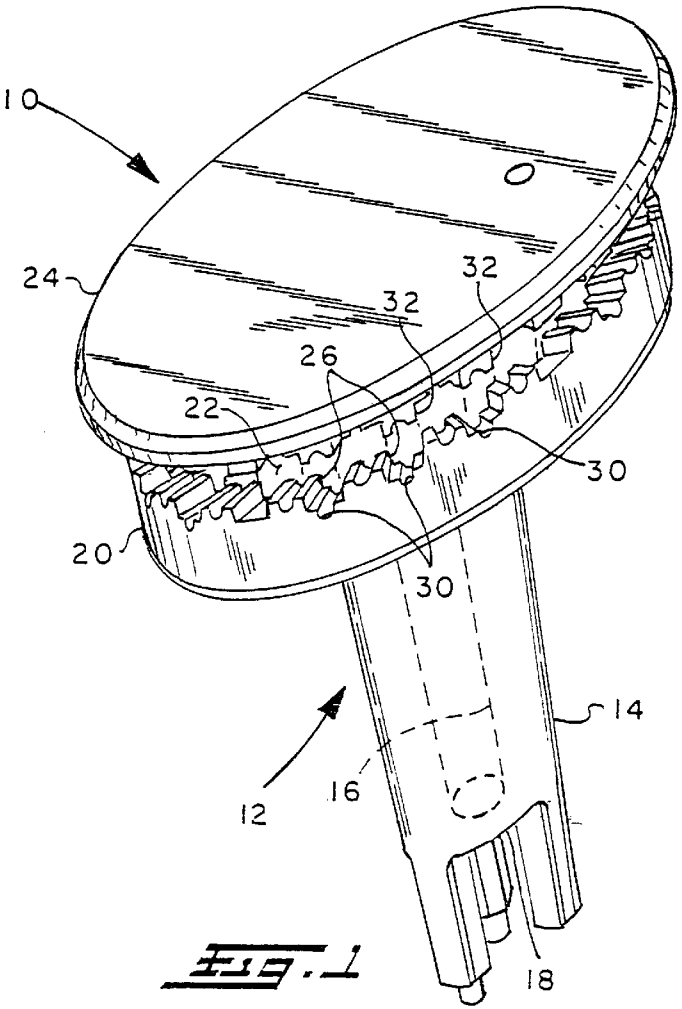
FIG. 1 is an exploded view of the burner assembly of the present invention showing the cap raised from the base.

Referring to FIGS. 1–4, the burner assembly of the present invention is indicated generally at 10 and has a base indicated generally at 12 having a tubular inlet portion 14 having an inlet passage 16 with cutouts 18 formed in the end thereof for aspirating air upon connection of a fuel supply conduit (not shown) to the inlet passage 16. Base 12 has formed integrally therewith on the end opposite cutouts 18 an enlarged diameter generally circular flange portion 20 which has formed in the end face thereof a cavity 22 which communicates with inlet passage 16. A burner cap 24 is disposed for, upon assembly to the base, closing cavity 22 to form a plenum or mixing chamber for the fuel air mixture entering cavity 22 through inlet passage 16.

The axial end face of the outer rim of flange 20, which forms the peripheral wall of cavity 22, is castellated with a plurality of circumferentially or annularly spaced axial projections denoted by reference numeral 26. In the presently preferred practice the base 12 is cast of aluminum material and the castellations or projections 26 have a generally rectangular configuration and are disposed in circumferentially equally spaced arrangement with the width in the circumferential direction equal for each of the projections 26. The top or axial end face surface 27 of each of the projections 26 is disposed to lie in a common plane to provide a generally flat peripheral surface to the rim of flange 20. Each of the top or axial end face surfaces 27 of the projections 26 has formed thereacross, in a radial direction, a groove 28 having preferably a semi-circular cross-section.

Figure 2:
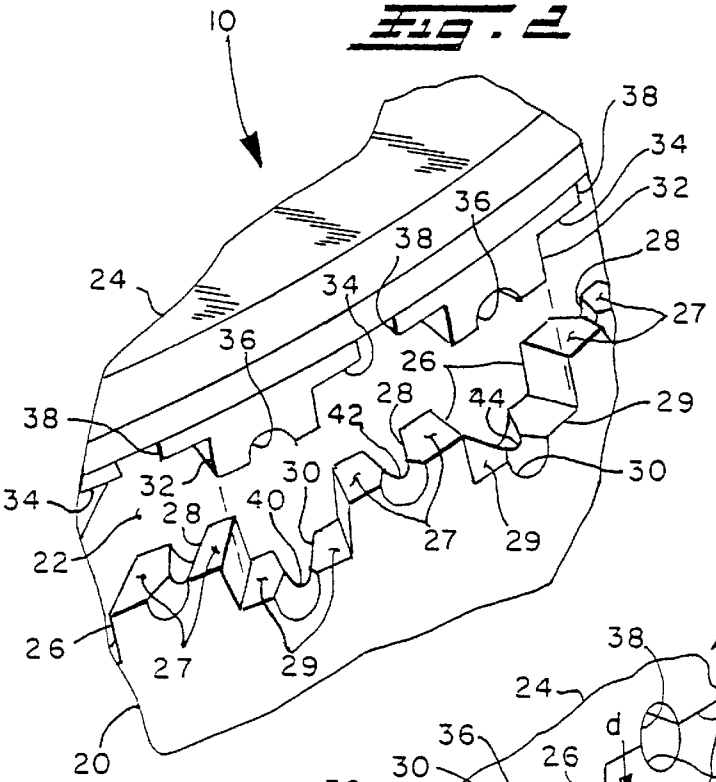
FIG. 2 is an enlarged view of a portion of the assembly of FIG. 1.

The circumferentially extending spaces between each of the projections 26 shown stippled in FIG. 2 have a generally rectangular cross-section and have formed in the bottom or axial face 29 thereof a groove 30 with a preferably semi-circular cross-section similar to grooves 28.

The burner cap 24 which is preferably cast of aluminum material has a plurality of circumferentially or annularly spaced projections 32 extending axially downwardly therefrom and configured to be interdigitated between the projections 26 of the burner base such that the cap surfaces 34 between the projections 32 register against the tops 27 of the projections 26 on the base.

Figure 3:
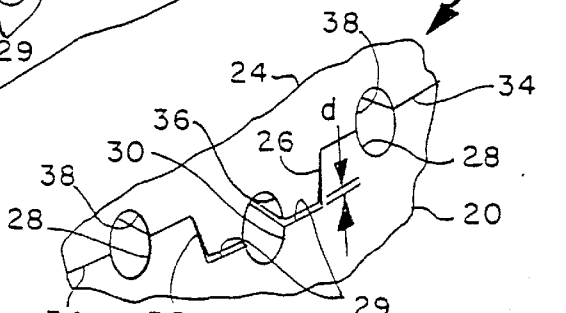
FIG. 3 is a portion of the burner assembly of FIG. 1 with the cap assembled onto the base.
Figure 4:
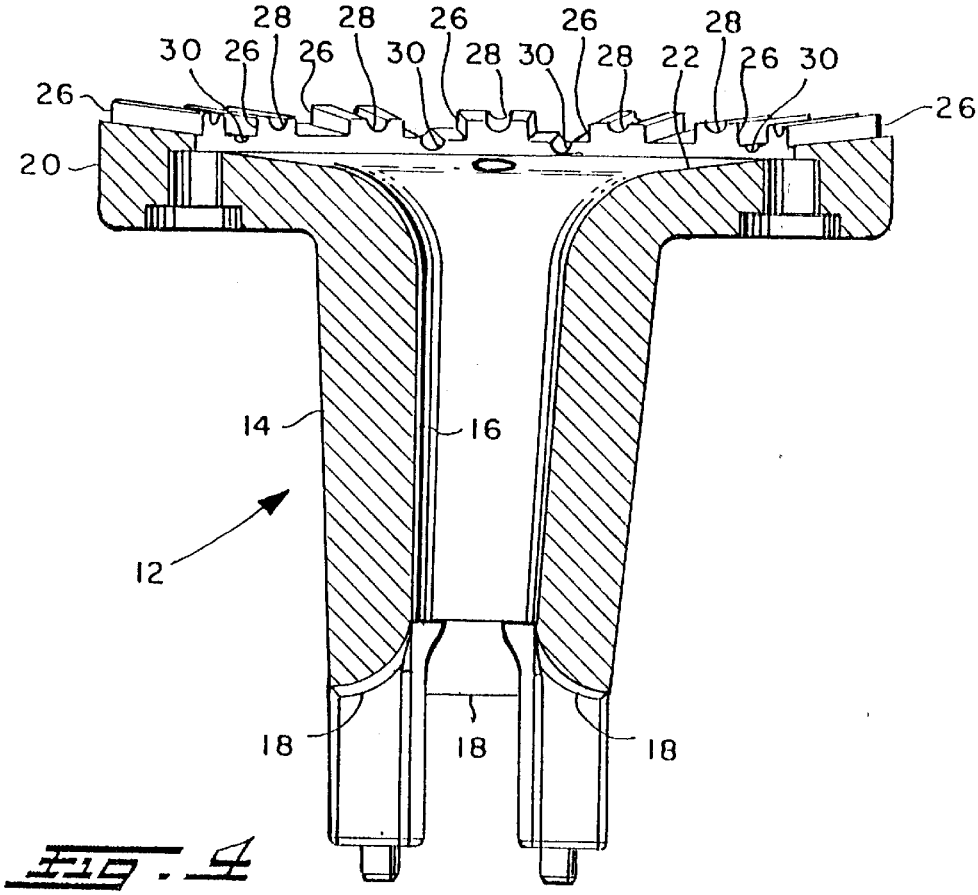
FIG. 4 is a cross-section taken through the base of the embodiment of FIG. 1; and, FIG. 5 is a view similar to FIG. 2, of another embodiment of the invention.

Each of the projections 32 on the cap 24 has the sides thereof slightly tapered as shown in FIGS. 2 and 3; and, the axial length or the depth thereof slightly less than the depth or corresponding height in the axial direction of the castellated portions 26 on base 14 such that, on assembly of the cap against the base, as shown in FIG. 3 a slight gap denoted by the reference character "d" in FIG. 3 exists between the projections 32 in the cap and the bottom 29 of the stippled grooves between the projections 26. This gap in conjunction with the tapered sides of cap projections 32 creates a flame stabilization passage around the projections 32 to permit a small amount of gaseous fuel air mixture to flow outwardly therethrough.

Each of the downward projections 32 on burner cap 24 has formed on the axial face or bottom thereof a radially extending groove denoted by reference numeral 36 which is preferably semi-circular in cross-section and which corresponds to and is located coincident with the adjacent groove 30 formed in the burner base 14 such that when the cap is registered against the burner base 14, the grooves 36 and 30 form a circular in cross-section flame-generating port through the rim of the burner flange 20. Similarly, radially extending grooves 38 are formed in the space between the projections 34 on the burner cap; and, these grooves 38 are disposed opposite the corresponding grooves 28 formed in the projections 26 on the burner base such that each pair of grooves 38,28 forms a primary flame-generating port having a circular cross-section. Thus, when the burner cap is registered against the burner base, each of the stippled spaces between the projections 26 has an auxiliary stabilization passage formed therein about the interdigitated downwardly extending projection 38 from the burner cap to provide small flow for stabilizing the flame in the corresponding primary burner port comprising the grooves 36,30.

Each of the primary flame generating ports formed by the grooves 28, 38, and 30, 36 and 28, 38 is formed preferably as shown in FIG. 2 into a converging-diverging nozzle having a venturi throat denoted respectively by the reference numerals 40, 42, 44.

Figure 5:
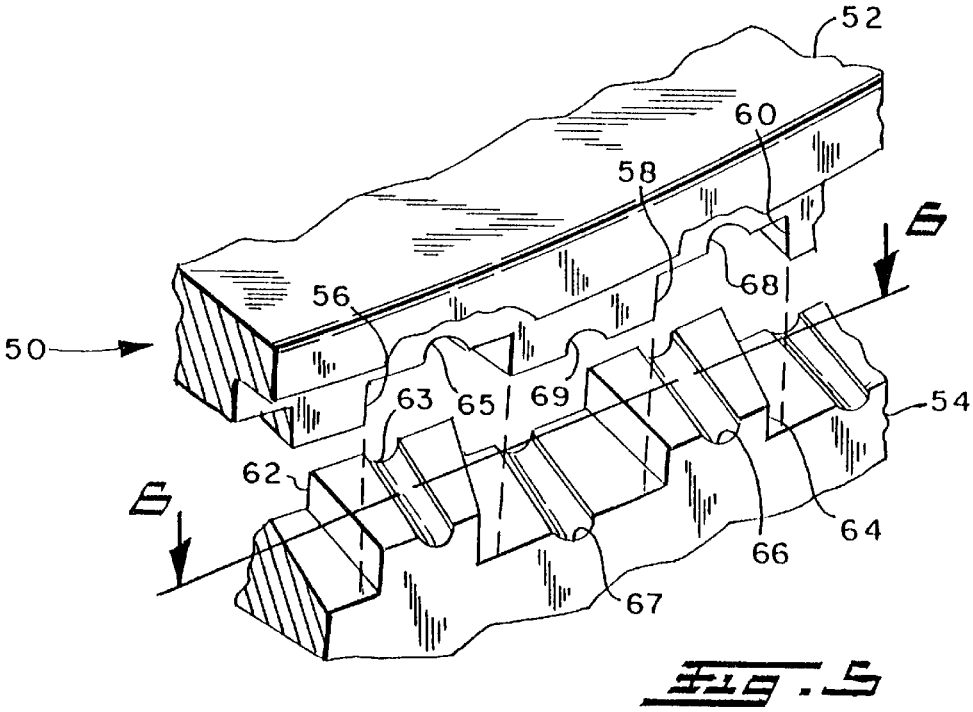
Figure 6:
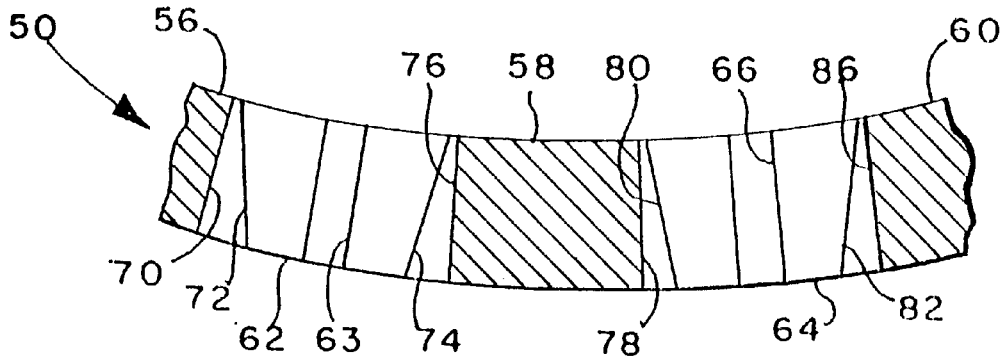
FIG. 6 is a section view taken along section indicating lines 6—6 of FIG. 5; and, FIG. 7 is a view similar to FIG. 6 of an alternate arrangement for the embodiment of FIG. 5.

Referring to FIGS. 5 and 6, an alternate embodiment of the invention indicated generally at 50 includes a burner cap 52 and base 54 having a plurality of castellated or raised portions 56, 58, 60 depending downwardly from the undersurface of the cap 52 which are interdigitated between corresponding upwardly extending spaced peripheral projections 62, 64 provided on the base 54. Primary flame generating ports are formed by the joining of oppositely disposed grooves 63 formed in projection 62 and groove 65 formed between projections 56, 58; grooves 67 formed between projections 62, 64 and groove 69 formed on projection 58; groove 66 formed on projection 64 and groove 68 formed between projections 58, 60.

Referring to FIGS. 5 and 6, the embodiment 50 has the auxiliary flame stabilization passages formed by the side 70 of lug 56 and the side 72 of lug 62; the opposite side 74 of lug 62 and the side 76 of lug 58; side 78 of lug 58 and side 80 of lug 64; the side 82 of lug 64 and the side 84 of lug 60. The opposite side 72 and 74 of lug 62 are tapered to thus create diverging nozzle passageways between the adjacent lugs 56, 58; and, the opposite sides 80, 82 of lug 64 are similarly tapered to provide diverging nozzle passageways between lug 64 and the adjacent lugs 58, 60. Thus, the embodiment 50 of FIGS. 5 and 6 provides the auxiliary flame stabilization passages in the form of diverging nozzles for reducing the flow velocity therethrough.

Figure 7:
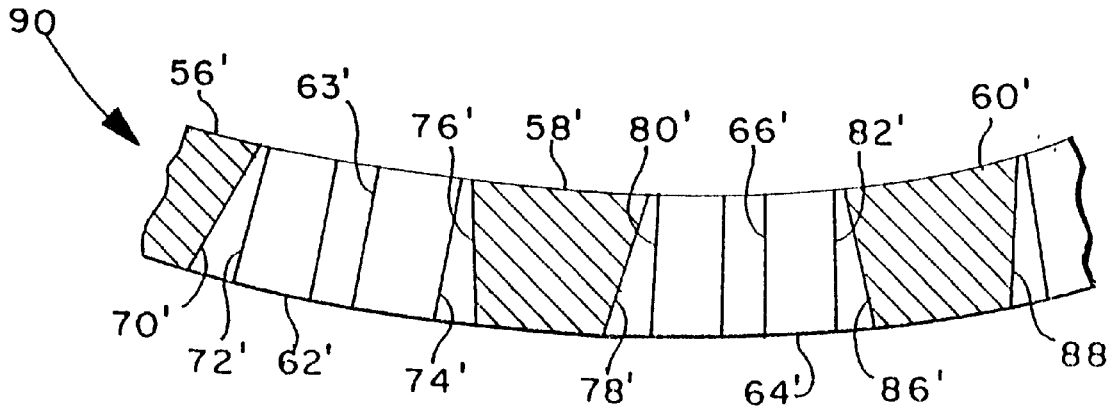

Referring to FIG. 7, an alternate embodiment of the invention is illustrated generally at 90 as having downwardly depending spaced peripheral lugs 56', 58', 60' depending from the cap which have the opposites sides thereof tapered as denoted by reference numeral 70' for lug 56', reference numerals 76', 78' for lug 58'; and, reference numerals 86', 88 for lug 60'. In the embodiment of FIG. 7, the lugs 62', 64', which extend upwardly from the burner base have the opposite sides thereof extending radially as denoted by reference numerals 72', 74' for lug 62' and 80', 82' for lug 64'.

The present invention thus provides a unique and novel gaseous fuel burner for cooktop applications having a cast aluminum base having a tubular inlet with an enlarged annular flange formed at one end forming a plenum therein when a cast aluminum burner cap is closed thereagainst. The parting line between the base and burner cap has a castellated configuration in the preferred form and comprises interdigitated preferably rectangular projections each having a groove formed in the end face thereof and in the bottom of the spaces therebetween with the grooves having a semicircular cross-section such that upon closure of the cap against the burner the corresponding adjacent pairs of grooves form primary flame-generating ports having a circular cross-section. The interdigitation of alternation projections on the cap with the spaces between the projections on the burner base provide a slight gap therebetween to form auxiliary flame stabilization passages for the flame emanating from the primary port formed therebetween.

The present invention thus provides for diverging nozzle configurations in the primary and auxiliary flame generating ports of a fuel gas burner for the purpose of reducing the flow velocity and minimizing the occurrence of flame separation from the generating port.

The improved burner of the present invention preferably has a converging-diverging nozzle configuration for the primary flame generating ports.

Although the present invention has hereinabove been described with respect to the illustrated embodiments, it will be understood that the invention is capable of modification and variation and is limited only by the following claims.

We claim:

1. A fuel gas burner assembly comprising:

(a) a base having an inlet portion and an inlet passage therein, and adapted for connection to a fuel gas source, and providing for air aspiration thereupon, said base having an enlarged portion defining a mixing cavity communicating with said inlet passage;

(b) a cap disposed on said base closing said mixing cavity to form a mixing chamber;

(c) said cap and base having corresponding cooperating surfaces thereon operative to define therebetween a plurality of spaced flame generating ports each communicating with said mixing chamber, wherein said cooperating surfaces are configured to provide primary nozzles diverging in the direction of flow in said ports; and (d) said cooperating surfaces are operative to define auxiliary flame stabilization passages disposed intermediate said flame generating ports and said auxiliary flame stabilization passages include secondary nozzles diverging in the direction of flow.

2. The assembly defined in claim 1, wherein said flame generating ports have a nozzle therein converging and then divering in the direction of flow.

3. A method of making a fuel gas burner comprising:

(a) forming a base having a fuel/air inlet portion and an enlarged mixing cavity portion;

(b) closing said cavity with a cap and forming a mixing chamber;

(c) forming cooperating surfaces on said base and cap and configuring said surfaces to form flame generating ports in said chamber diverging in the direction of flow; and (d) configuring said cooperating surfaces to form diverging flame stabilizing ports between said flame generating ports.

4. The method defined in claim 3, wherein said step of configuring said surfaces includes forming flame generating ports converging and then diverging in the direction of flow.

* * * * *